US006641333B2

(12) United States Patent
Bartlett et al.

(10) Patent No.: US 6,641,333 B2
(45) Date of Patent: Nov. 4, 2003

(54) METHOD OF FORMING ENLARGED PILE HEADS

(75) Inventors: Graham Bartlett, Bristol (GB); Melvin Gerrard England, Middlesex (GB)

(73) Assignee: Cementation Foundations Skanska Limited, Hertfordshire (GB)

( * ) Notice: Subject to any disclaimer, the term of this patent is extended or adjusted under 35 U.S.C. 154(b) by 0 days.

(21) Appl. No.: 10/214,463

(22) Filed: Aug. 8, 2002

(65) Prior Publication Data

US 2003/0049079 A1 Mar. 13, 2003

(30) Foreign Application Priority Data

Aug. 8, 2001 (GB) ..... 0119372

(51) Int. Cl.[7] ..... E02D 5/74
(52) U.S. Cl. ..... 405/233; 405/244; 405/256
(58) Field of Search ..... 405/232, 231, 405/233, 236, 237, 238, 239, 240, 253, 256, 257, 244

(56) References Cited

U.S. PATENT DOCUMENTS 1,792,333 A * 2/1931 Takechi ..... 405/232
2,332,168 A * 10/1943 Riches ..... 405/244
2,923,133 A * 2/1960 Muller ..... 405/236
5,234,290 A * 8/1993 Collins ..... 405/249
5,486,071 A * 1/1996 Bullivant ..... 405/229
5,683,207 A * 11/1997 Mauer ..... 405/244
5,833,399 A * 11/1998 Bullivant ..... 405/233
6,168,350 B1 * 1/2001 Bartlett ..... 405/240

FOREIGN PATENT DOCUMENTS

GB 2 284 843 A 6/1995
GB 2 293 850 A 4/1996

* cited by examiner

*Primary Examiner*—Heather Shackelford
*Assistant Examiner*—Frederick L. Lagman
(74) *Attorney, Agent, or Firm*—Browdy and Neimark, P.L.L.C.

(57) ABSTRACT

The present application relates to a method of installing a pre-cast pile in the ground which involves applying an enlarged head forming tool to the ground until a volume of soil has been displaced or removed so as to form a void at the surface of the ground. The pre-cast pile is then driven into the ground to a predetermined depth below the void and the void is then filled with concrete or grout to form a cast-in-situ pile head. The diameter of the pile head is greater than the diameter of the pile shaft.

19 Claims, 5 Drawing Sheets

METHOD OF FORMING ENLARGED PILE HEADS

BACKGROUND OF THE INVENTION

1. Technical Field of the Invention

The present invention relates to a method of installing a pre-cast pile in the ground, the method involving the construction of an enlarged diameter pile head.

2. Prior Art

Piles are used in the construction industry to provide foundation support for buildings and the like. Two common piling techniques involve the use of cast-in-situ piles and pre-cast piles. Cast-in-situ methods involve the use of an auger to penetrate the ground to a certain depth so as to form an underground void. Concrete is then pumped into the underground void left by the auger so as to form an underground column. In driven piling operations, a pre-cast concrete pile is driven into the ground, usually by means of successive percussive forces applied to the head of the pile, until a predetermined depth is reached. The top of the pile column may need to be trimmed to a level at, or just below, the ground.

It is advantageous in some applications for the top, or head, of a foundation pile to have a larger diameter than the main shaft, since this allows the load of the building structure to be spread over a wider area.

Known methods for achieving what is called an "enlarged diameter pile head" involve casting a pile in the ground, either by pre-cast driven or cast-in-situ techniques, and subsequently excavating a volume of soil around the head of the pile. Additional concrete is then poured or pumped into the excavated void so as to form the enlarged diameter head. This method however suffers from the disadvantage that it is often necessary for the top of the installed pile to be broken as the head volume is excavated. This can cause discontinuities or cracks to occur in the pile shaft, which will inevitably weaken the load bearing capacity of the pile.

Alternatively, an enlarged pile head may be formed by affixing an enlarged head former, in the form of a collar device having a central aperture, to the lower end of the piling tool. The tool and enlarged head former are then driven into the ground by a predetermined distance so as to displace or excavate an area of soil whose diameter is larger than the section or diameter of the main shaft. The enlarged head former is then disconnected and the hole forming process continues as the piling tool passes freely through the central aperture of the former. During withdrawal of the piling tool, concrete or grout is supplied to the lower end of the tool so as to form a cast-in-situ underground pile. As the lower end of the piling tool is brought up to ground level, the enlarged head former is re-connected to the piling tool and is thereby lifted from the ground. The void left behind is filled with concrete or grout so as to form an enlarged pile head. Techniques employing the use of an enlarged head former, or collar device, are described in GB 2334543, the disclosure of which is incorporated herein by way of reference thereto.

OBJECT AND SUMMARY OF THE INVENTION

While this method is found to be quite effective, in many piling operations it is more appropriate to use techniques which employ pre-cast piles. There is therefore a need to provide a method of forming an enlarged diameter pile head at the top of a pre-cast pile, without detriment to the continuity of the pile shaft.

According to the present invention, there is provided a method of installing a pre-cast pile in the ground, the method comprising the steps of:

i) applying an enlarged head forming tool to the ground until a volume of soil has been displaced or removed, thereby forming a void at the surface of the ground;

ii) driving a pre-cast pile into the ground to a predetermined depth below the void formed in step i);

iii) filling the void with concrete or grout to form a cast-in-situ pile head, wherein the diameter of the pile head is greater than the diameter of the pile shaft.

Preferably, the enlarged head forming tool has a substantially central aperture. This allows a drive dolly to be positioned in the enlarged head forming tool to facilitate the penetration of the tool into the ground. Preferably the tool is driven into the ground by means of a percussive force being applied to the top of the drive dolly by means of a hammer. Alternatively, the enlarged head forming tool may be driven into the ground by means of rotation. This may be facilitated by means of an auger which is releasably fitted to the tool.

In preferred embodiments of the present invention, the pre-cast pile may be driven into the ground through the central aperture in the enlarged head forming tool; the latter being removed after the installation of the pre-cast pile. This is preferably achieved by means of a percussive force being applied to the top of the pile.

Once the pile has been driven into the ground, and the enlarged head former has been removed, the pre-cast pile is broken down to a predetermined level below the ground. Preferably, the pile is broken down to between 100 mm and 150 mm below the ground. A reinforcement cage may also be placed within the void above the trimmed pre-cast pile before the void is filled with concrete or grout. The reinforcement cage advantageously serves to supplement the strength and load bearing capacity of the enlarged diameter pile head.

A number of configurations are envisaged for the enlarged pile head forming tool including those of circular, square or hexagonal cross section. The tool may comprise a collar device having a longitudinal section with two substantially parallel sides and a tapered section. Alternatively, the tool may comprise a first cylindrical section of greater diameter, a second cylindrical section having a smaller diameter and a tapered section extending between said first and second cylindrical sections. Furthermore, the outer surface of the tool may be provided with one or a number of blades which can be advantageously arranged to facilitate the radial flow of material in an outward direction as the tool penetrates the ground.

The enlarged head forming tool is advantageously provided on its upper surface with a pair of hooks or loops so as to allow it to be lifted by a fork-lift truck or the like, or alternatively to which a lifting winch may be attached.

BRIEF DESCRIPTION OF THE DRAWINGS

For a better understanding of the present invention, and to show how it may be carried into effect, reference shall now be made by way of example to the accompanying drawings, in which.

DETAILED DESCRIPTION OF THE PREFERRED EMBODIMENT OF THE INVENTION

Figure 1:
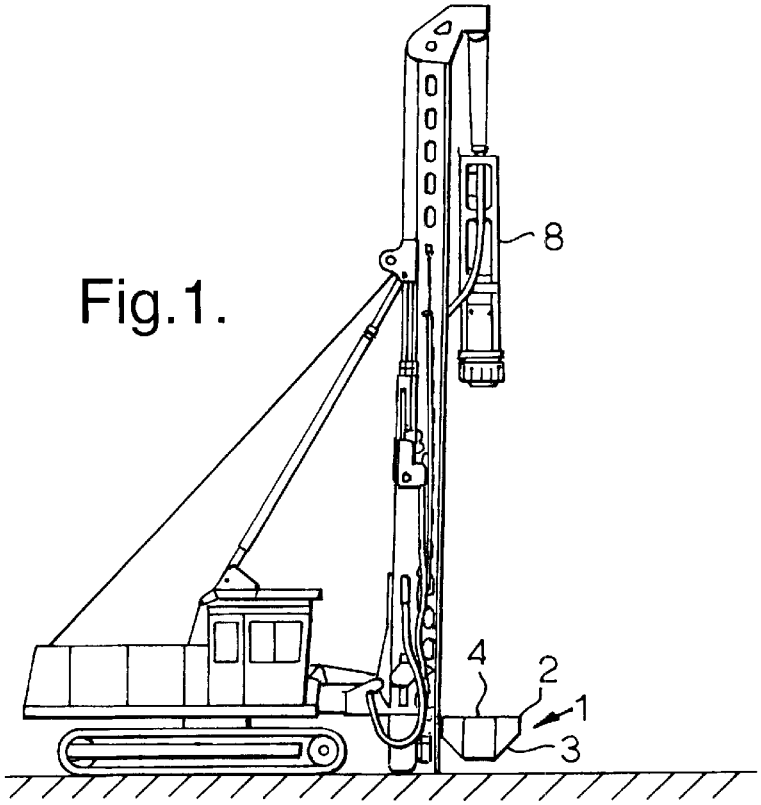
FIGS. 1 to 8 show the sequence of operation of a piling rig for installing a pile in the ground according to embodiments of the present invention.
Figure 2:
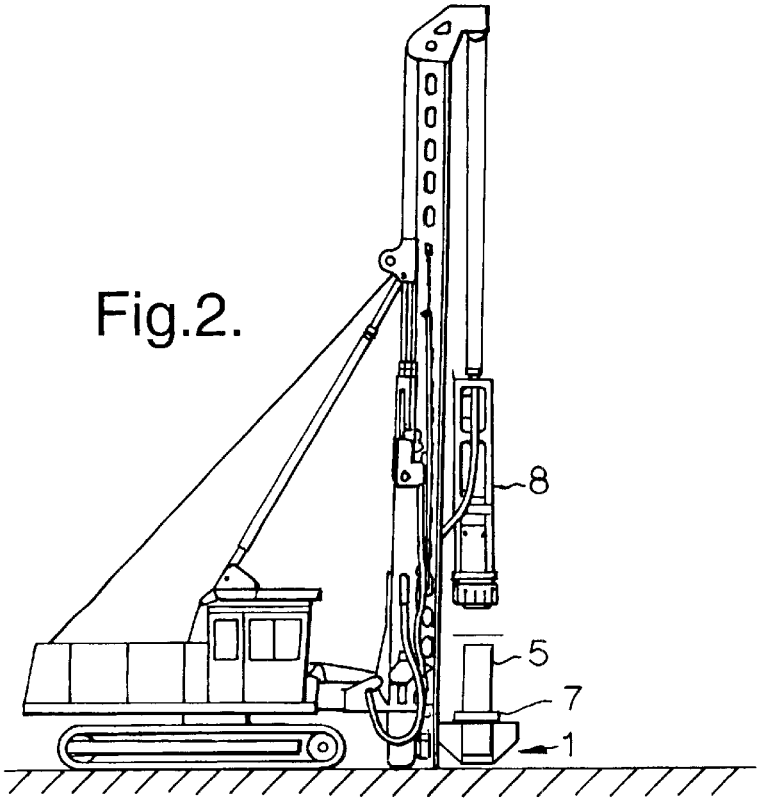

FIG. 1 shows an enlarged head forming tool 1 positioned over the required pile position on the ground. The enlarged head forming tool comprises a cylindrical section 2 and a tapered section 3. A central aperture 4 extends through the device into which a drive dolly 5 may be positioned. The lower end of the drive dolly is accommodated within the central aperture of the enlarged head former. The drive dolly is provided with a circumferential rim 7 which has a greater diameter than the diameter of the central aperture 4. This enables the percussive force applied to the drive dolly by means of a hammer 8, to be transmitted to the enlarged head forming tool, as shown in FIG. 2.

Figure 3:
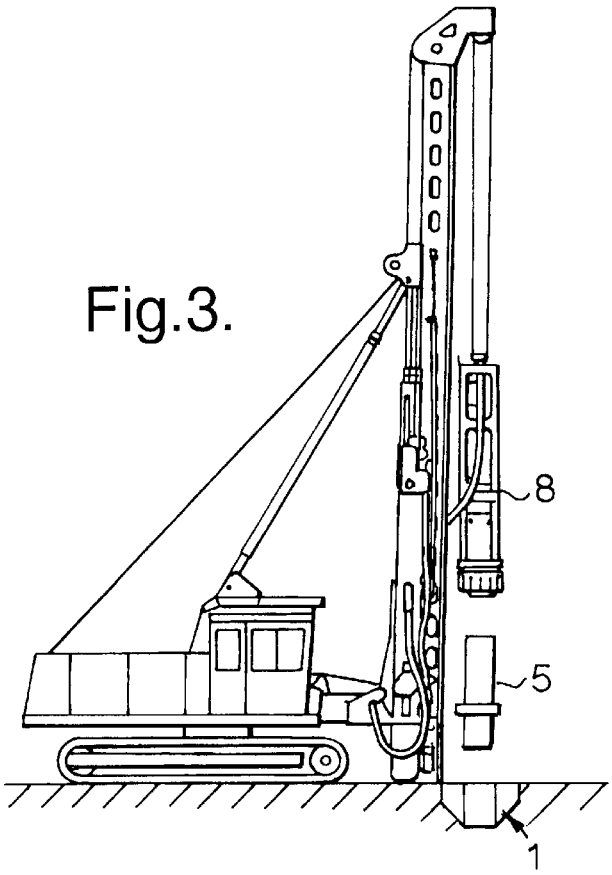
Figure 4:
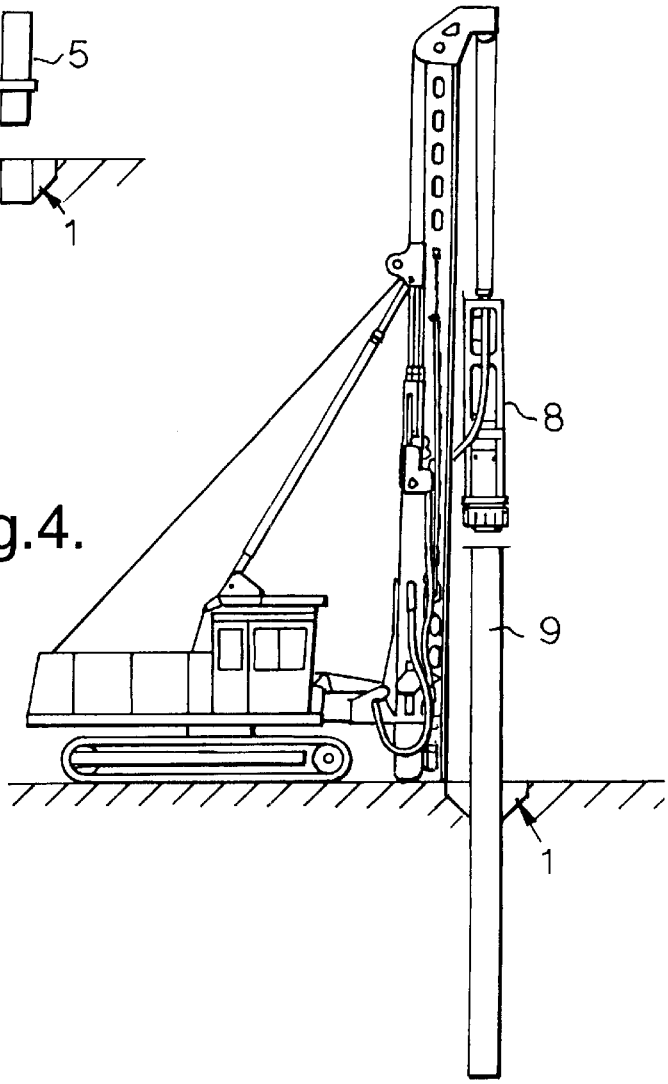
Figure 5:
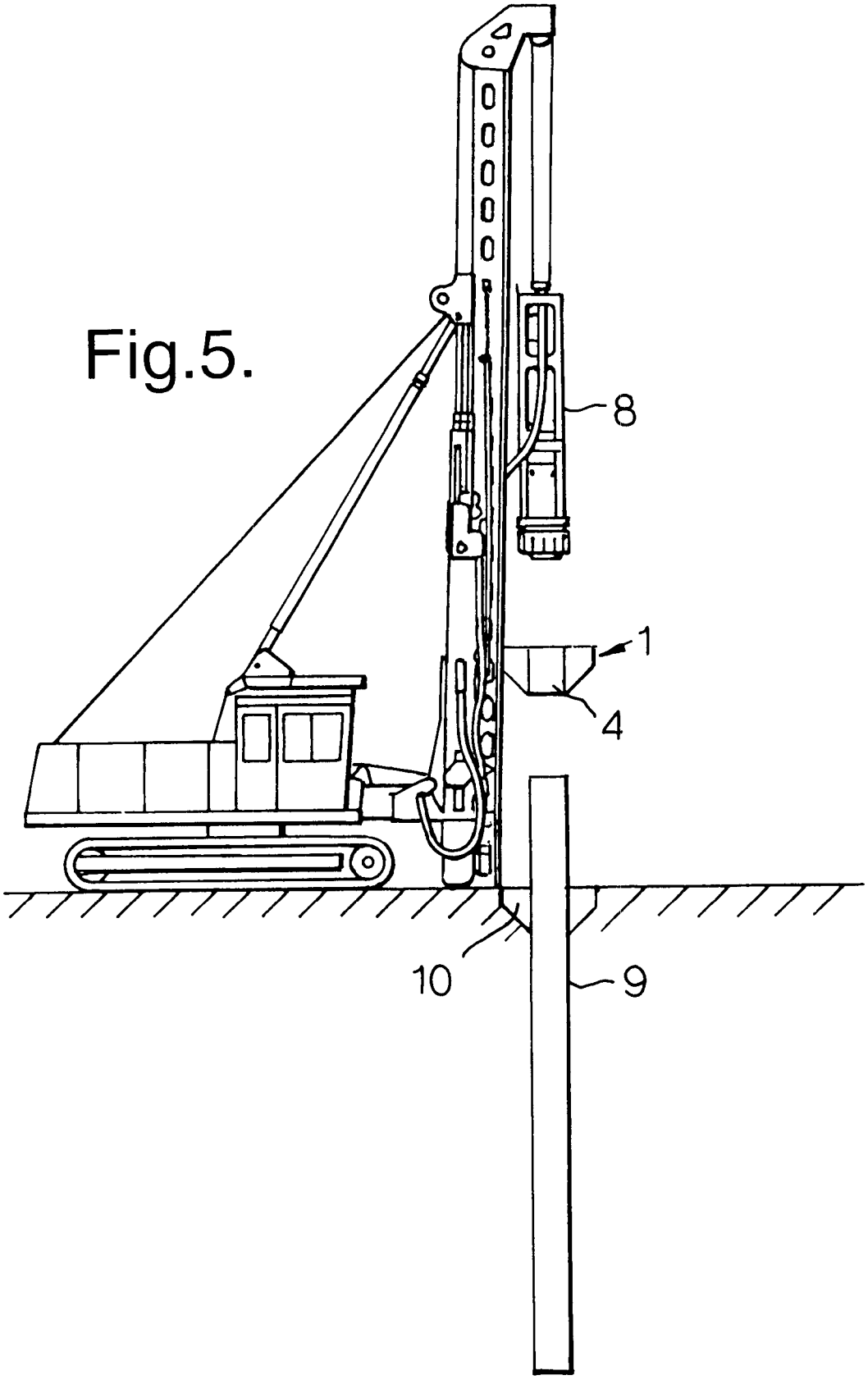

Once the enlarged head forming tool has reached a predetermined depth, the hammer 8 is lifted and the drive dolly 5 is raised and removed as shown in FIG. 3. FIG. 4 shows the installation of a pre-cast pile 9 in the ground. The hammer 8 is suspended by a winch and exerts a series of percussive blows on the top of the pile 9, thereby causing the pile to be driven into the ground through the central aperture 4 in the enlarged head forming tool 1. Once the pile 9 has reached a predetermined distance below the ground, the hammer 8 is raised and the enlarged head forming tool 1 is removed, as shown in FIG. 5, to leave a void 10 at the head of the pile 9.

Figure 6:
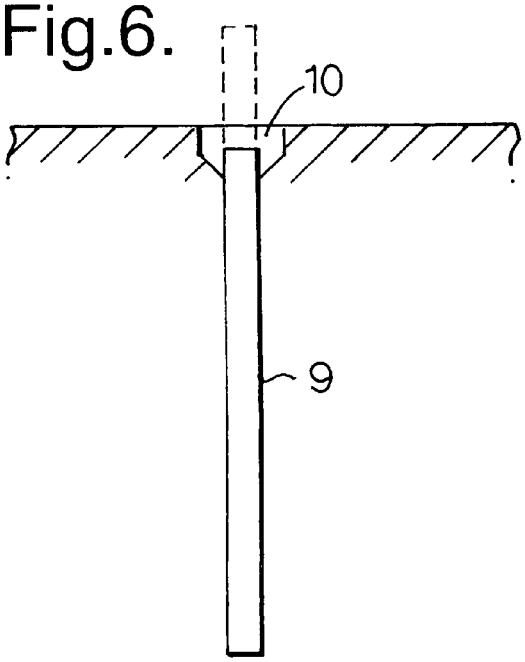
Figure 7:
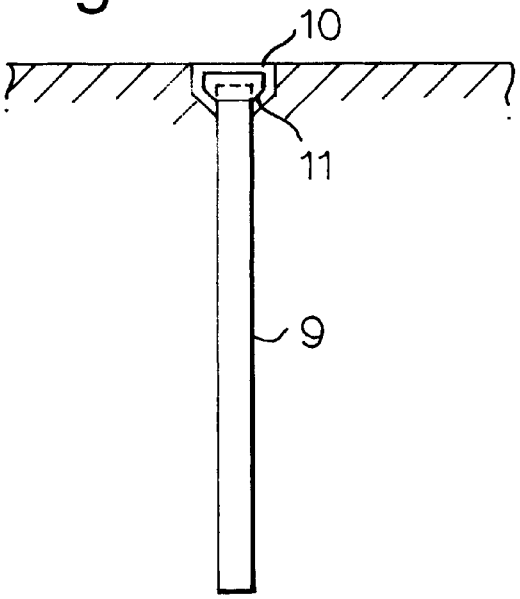
Figure 8:
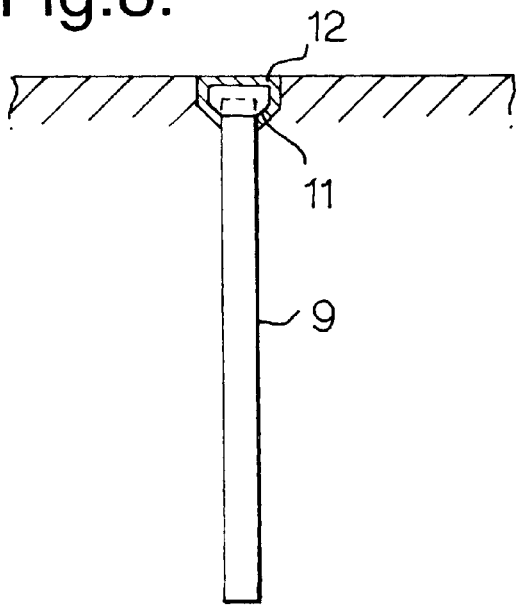

As it is common for the pre-cast pile to be supplied as a standard length, it will usually be necessary for the excess portion of the pre-cast pile to be broken down to a predetermined level below the ground. This is illustrated in FIG. 6. FIGS. 7 and 8 show a reinforcement cage 11 being positioned over the broken down pile 9 before concrete is pumped into the void to form a cast-in-situ enlarged diameter pile head 12. Reinforcement bar(s) may be dowled into the pile shaft and extended into the enlarged diameter head to form a mechanical joint to provide tension capability.

Figure 9:
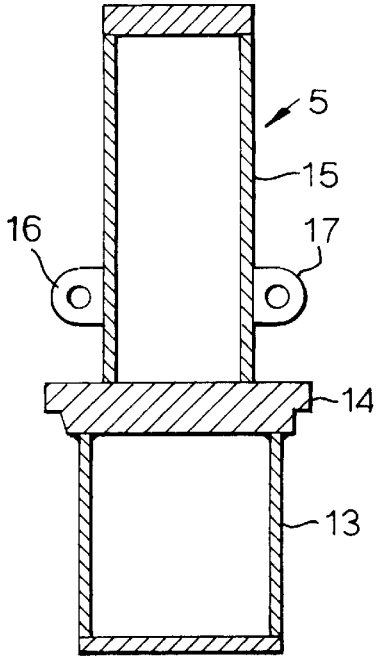
FIG. 9 shows a vertical cross-section through a drive dolly to which a percussive force is applied to cause the enlarged head former to penetrate the ground.
Figure 10:
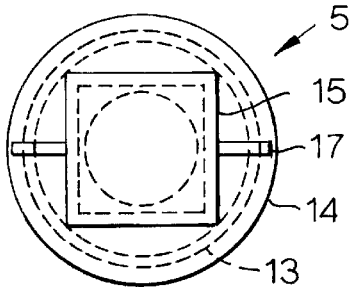
FIG. 10 shows a plan view of a drive dolly from above.

FIG. 9 shows a vertical cross section through a drive dolly 5 having a longitudinal section 13 which is designed to be accommodated within the central aperture of the enlarged head forming tool. A percussive force is applied to the top of a second longitudinal section 15. A circumferential rim 14, located between the two longitudinal sections and having a larger diameter than the aperture of the head forming tool, enables the percussive force applied to the drive dolly to be transmitted to the head forming tool. The drive dolly is provided with a pair of hooks 16 and 17 which enable the tool to be lifted or lowered as necessary. A plan view of the drive dolly from above is shown in FIG. 10.

Figure 12:
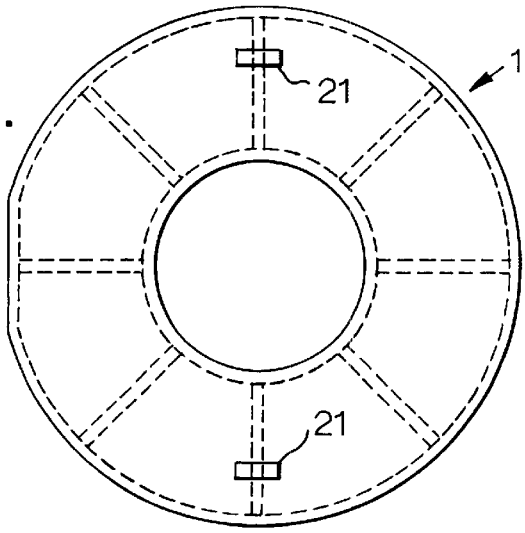
FIG. 12 shows a plan view of an enlarged head former.
Figure 11:
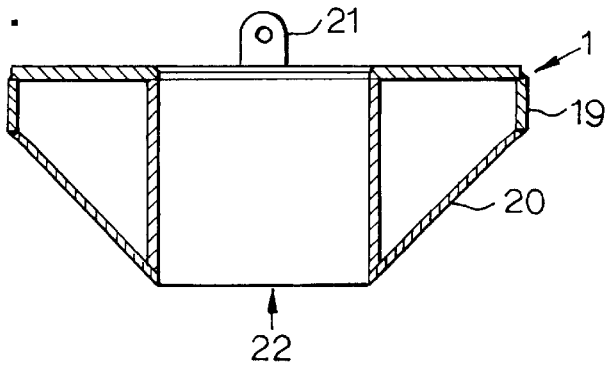
FIG. 11 shows a vertical cross-section through an enlarged head former.

FIG. 11 shows an enlarged head forming tool 1, the outer surface of which comprises a cylindrical shaped section 19 and a tapered section 20. The tool is also provided with a central aperture 22 and may be made of metal or any other substantially rigid material. A pair of loops 21 allow the tool to be lifted by means of a fork-lift truck or lifting winch. FIG. 12 shows a plan view, taken from above, of the enlarged pile head forming tool shown in FIG. 11.

What is claimed is:

1. A method of installing a precast pile in the ground, the method comprising the steps of:

i) driving an enlarged head forming tool into the ground until a volume of soil has been displaced or removed, thereby forming a void at the surface of the ground;

ii) driving a precast pile into the ground through the enlarged head forming tool to a predetermined depth below the void formed in step i);

iii) filing the void with concrete or grout directly around an upper end of the precast pile to form a cast-in-situ pile head, wherein the diameter of the pile head is greater than the diameter of the pile shaft.

2. A method as claimed in claim 1, wherein the enlarged head forming tool comprises a collar having a longitudinal section and a tapered section.

3. A method as claimed in claim 1 or 2, wherein the enlarged head forming tool has a substantially central aperture.

4. A method as claimed in claim 3, wherein a drive dolly is placed within the substantially central aperture and a percussive force is applied to the top of the drive dolly thereby causing the enlarged head forming tool to penetrate the ground.

5. A method as claimed in claim 4, wherein the drive dolly is removed once the enlarged head forming tool has reached the predetermined depth.

6. A method as claimed in claim 1, wherein the enlarged head forming tool is driven into the ground by means of rotation.

7. A method as claimed in claim 1, wherein the precast pile is driven into the ground by means of a percussive force being applied to the top of the precast pile.

8. A method as claimed in claim 7, wherein the precast column is driven into the ground through a central aperture in the enlarged head forming tool.

9. A method as claimed in claim 1, wherein the enlarged head forming tool is removed from the void formed at the surface of the ground after the installation of the precast pile in the ground.

10. A method as claimed in claim 1, wherein the precast pile, having been driven into the ground, is broken to a predetermined level below the ground to form the upper end of the precast pile.

11. A method as claimed in claim 10, wherein the precast pile is broken down to 100 mm to 150 mm below the ground.

12. A method as claimed in claim 10, wherein a reinforcement cage is placed over the upper end of the precast pile before the void left by removal of the enlarged head former is filled with concrete to grout, the reinforcement cage serving to supplement the strength of the enlarged diameter pile head.

13. A method as claimed in claim 10, wherein before the void left by the enlarged head former is filled with concrete or grout, one or a number of reinforcement bars are dowled into the precast pile shaft such that they extend into said void, the reinforcement bars serving to supplement the strength of the enlarged diameter pile head.

14. A method of installing a precast pile in the ground, the method comprising the steps of:

i) driving an enlarged head forming tool into the ground until a volume of soil has been displaced or removed, thereby forming a void at the surface of the ground;

ii) driving a precast pile into the ground through the enlarged head forming tool to a predetermined depth below the void formed in step i);

iii) filing the void with concrete or grout directly around an upper end of the precast pile to form a cast-in-situ pile head, wherein the diameter of the pile head is greater than the diameter of the pile shaft;

wherein a reinforcement cage is placed over the upper end of the precast pile before the void left by removal of the enlarged head former is filled with concrete to grout, the reinforcement cage serving to supplement the strength of the enlarged diameter pile head.

15. A method as claimed in claim 14, wherein the enlarged head forming tool comprises a collar having a longitudinal section and a tapered section.

16. A method as claimed in claim 14, wherein the enlarged head forming tool has a substantially central aperture.

17. A method as claimed in claim 16, wherein a drive dolly is placed within the substantially central aperture and a percussive force is applied to the top of the drive dolly thereby causing the enlarged head forming tool to penetrate the ground.

18. A method as claimed in claim 17, wherein the drive dolly is removed once the enlarged head forming tool has reached the predetermined depth.

19. A method as claimed in claim 14, wherein the enlarged head forming tool is driven into the ground by means of rotation.

* * * * *